US010730085B2

(12) United States Patent
Tang et al.

(10) Patent No.: US 10,730,085 B2
(45) Date of Patent: Aug. 4, 2020

(54) DEVICE FOR WASHING PIPES AND METHOD OF CONNECTING THE SAME

(71) Applicant: Jiangsu Bolong Jinxin Environmental Protection Equipment Co. Ltd., Changzhou, Jiangsu Province (CN)

(72) Inventors: Jian-Zhong Tang, Changzhou (CN); Da-Ming Xun, Changzhou (CN)

(73) Assignee: Jiangsu Bolong Jinxin Environmental Protection Equipment Co. Ltd., Jiangsu Province (CN)

( * ) Notice: Subject to any disclaimer, the term of this patent is extended or adjusted under 35 U.S.C. 154(b) by 82 days.

(21) Appl. No.: 15/892,430

(22) Filed: Feb. 9, 2018

(65) Prior Publication Data

US 2019/0247899 A1 Aug. 15, 2019

(51) Int. Cl.

| | |
|---|---|
| ***B08B 9/047*** | (2006.01) |
| ***B08B 9/045*** | (2006.01) |
| ***A46B 13/02*** | (2006.01) |

(52) U.S. Cl.

CPC ..... *B08B 9/047* (2013.01); *A46B 13/02* (2013.01); *B08B 9/045* (2013.01); *B08B 2209/04* (2013.01)

(58) Field of Classification Search

CPC .. B08B 9/00; B08B 9/02; B08B 9/027; B08B 9/04; B08B 9/045; B08B 9/047;

(Continued)

(56) References Cited

U.S. PATENT DOCUMENTS 1,345,480 A * 7/1920 Darlington ..... B08B 9/047 15/104.12
2,384,872 A * 9/1945 Baker ..... B01J 8/02 418/100

(Continued)

FOREIGN PATENT DOCUMENTS

KR 101711634 B1 * 3/2017
SE 1650539 * 4/2017

(Continued)

*Primary Examiner* — Orlando E Aviles
*Assistant Examiner* — Robert F Neibaur
(74) *Attorney, Agent, or Firm* — Karin L. Williams; Mayer & Williams PC

(57) ABSTRACT

A device for washing pipes contains: a connector, a case, an impeller, a rotary shaft, an actuation portion, a transmission portion, a cleaning portion, multiple moveable portions, and multiple positioning elements. The connector includes an inflow section, a threaded portion, a connection section, and an inlet. The case includes a partition, an accommodation portion, a screwing orifice, multiple outlets, multiple fixing orifices, a guide portion, and multiple guiding orifices. The impeller includes multiple fins and a central hole. The rotary shaft includes an affix segment. The actuation portion includes a first aperture, multiple second apertures, and a conduct portion. The transmission portion includes a third aperture, multiple drive shafts, an output section, multiple fourth apertures, and multiple fifth apertures. The cleaning portion includes a first opening, multiple second openings, and multiple clean elements. Each has multiple coupling holes, and multiple positioning elements fix related components of the device.

9 Claims, 6 Drawing Sheets

(58) Field of Classification Search
CPC ..... B08B 2209/04; B08B 2209/027; B08B 2209/02; B08B 2209/032; B08B 9/051; B08B 9/0436; B80B 9/0436
USPC ..... 15/104.12, 104.09, 104.9
See application file for complete search history.

(56) References Cited

U.S. PATENT DOCUMENTS 2,497,659 A * 2/1950 Davis ..... E21B 37/02 166/66.4
2,596,571 A * 5/1952 Lewenhagen ..... B08B 9/0553 15/104.061
2,742,259 A * 4/1956 Boucher ..... F16L 55/30 254/134.5

FOREIGN PATENT DOCUMENTS

SE 1650539 * 10/2017 ..... B08B 9/051
SU 1227267 A1 * 4/1986

* cited by examiner

DEVICE FOR WASHING PIPES AND METHOD OF CONNECTING THE SAME

FIELD OF THE INVENTION

The present invention relates to a device for washing pipes and a method of connecting the same.

BACKGROUND OF THE INVENTION

Pipes (such as a water pipe, an intake pipe, etc.) are washed by using a spray gun or a spray head, for example, the spray gun or the spray head sprays water into an inner wall of the pipes by way of water and a water pressure.

However, such a washing method cannot wash interior of the water pipes cleanly.

The present invention has arisen to mitigate and/or obviate the afore-described disadvantages.

SUMMARY OF THE INVENTION

The primary aspect of the present invention is to provide a device for washing pipes and a method of connecting the same which movably and rotatably wash the pipes effectively.

To obtain the above aspect, a device for washing pipes provided by a preferred embodiment the present invention contains: a connector, a case, an impeller, a rotary shaft, an actuation portion, a transmission portion, a cleaning portion, multiple moveable portions, and multiple positioning elements.

The connector is a stepped sleeve and includes a conical inflow section, a threaded portion, a connection section having inner threads, and an inlet formed in a trumpet shape and defined in the connector.

The case is a hollow cylinder and includes a partition arranged on a front end of the case, an accommodation portion defied on the partition, a screwing orifice formed on a rear end of the case, multiple outlets arranged on a peripheral side of the case, multiple fixing orifices defined around the peripheral side of the case adjacent to the conical inflow section, a conical guide portion defined in a center of the front end of the case and having outer threads, and multiple guiding orifices defined between the guide portion and the front end of the case and passing through the partition.

The impeller includes multiple fins extending outward from an outer wall of the impeller, and the impeller includes a central hole defined on a center of the impeller.

The rotary shaft includes an affix segment extending outwardly from a front end of the rotary shaft.

The actuation portion is formed in a circular disc and includes a first aperture, multiple second apertures surrounding the first aperture, and a conduct portion arranged on a front end of the actuation portion, wherein the conduct portion has a first end adjacent to the impeller and has a second end away from the impeller, a diameter of a first end of the conduct portion is less than the second end of the conduct portion, and the second end of the conduct portion has screw threads formed thereon.

The transmission portion is cylindrical and includes a third aperture defined on a front end of the transmission portion, multiple drive shafts mounted around the third aperture, an output section connected on a rear end of the transmission portion and a diameter of the output section being less than the transmission portion. The output section has a planetary gear mechanism formed in the output section, multiple fourth apertures defined on an outer wall of the transmission portion proximate to the front end of the transmission portion, and multiple fifth apertures arranged on an outer wall of the output section.

The cleaning portion includes a first opening defined on a center of the cleaning portion, multiple second openings arranged on a front edge of an outer wall of the cleaning portion, and multiple clean elements away from the front edge of an outer wall of the cleaning portion.

Each of multiple moveable portions has multiple coupling holes.

The multiple positioning elements are configured to fix related components of the device.

A method of connecting the device contains steps of:

(a). screwing inner threads of a connection section of a connector with outer threads of a guide portion of a case;

(b). inserting an affix segment of a rotary shaft into a central hole of an impeller and inserting an end of the rotary shaft into a first aperture of an actuation portion;

(c). accommodating the impeller into an accommodation portion of a partition of the case and screwing screw threads of a conduct portion with a screwing orifice of the case;

(d). inserting multiple drive shafts of a transmission portion into multiple second apertures of the actuation portion respectively and inserting the rotary shaft of the actuation portion into a third aperture of the transmission portion;

(e). placing an output section of the transmission portion into a first opening of a cleaning portion and inserting multiple positioning elements into multiple second openings and multiple fifth apertures of the transmission portion; and (f). placing each moveable portion in the case and outside the transmission portion and inserting the multiple positioning elements into multiple coupling holes, multiple fixing orifices, and multiple fourth apertures individually.

Preferably, the case includes three outlets, three fixing orifices, and three guiding orifices.

Preferably, the actuation portion includes six second apertures.

Preferably, the transmission portion includes six drive shafts.

Preferably, the transmission portion includes three fourth apertures.

Preferably, the cleaning portion includes three second openings.

Preferably, a number of the multiple moveable portions is three, and each moveable portion is comprised of a holder and two rollers.

Preferably, each of the multiple positioning elements is any one of a screw, a screw bolt, and a screw nail.

DETAILED DESCRIPTION OF THE PREFERRED EMBODIMENTS

Figure 1:
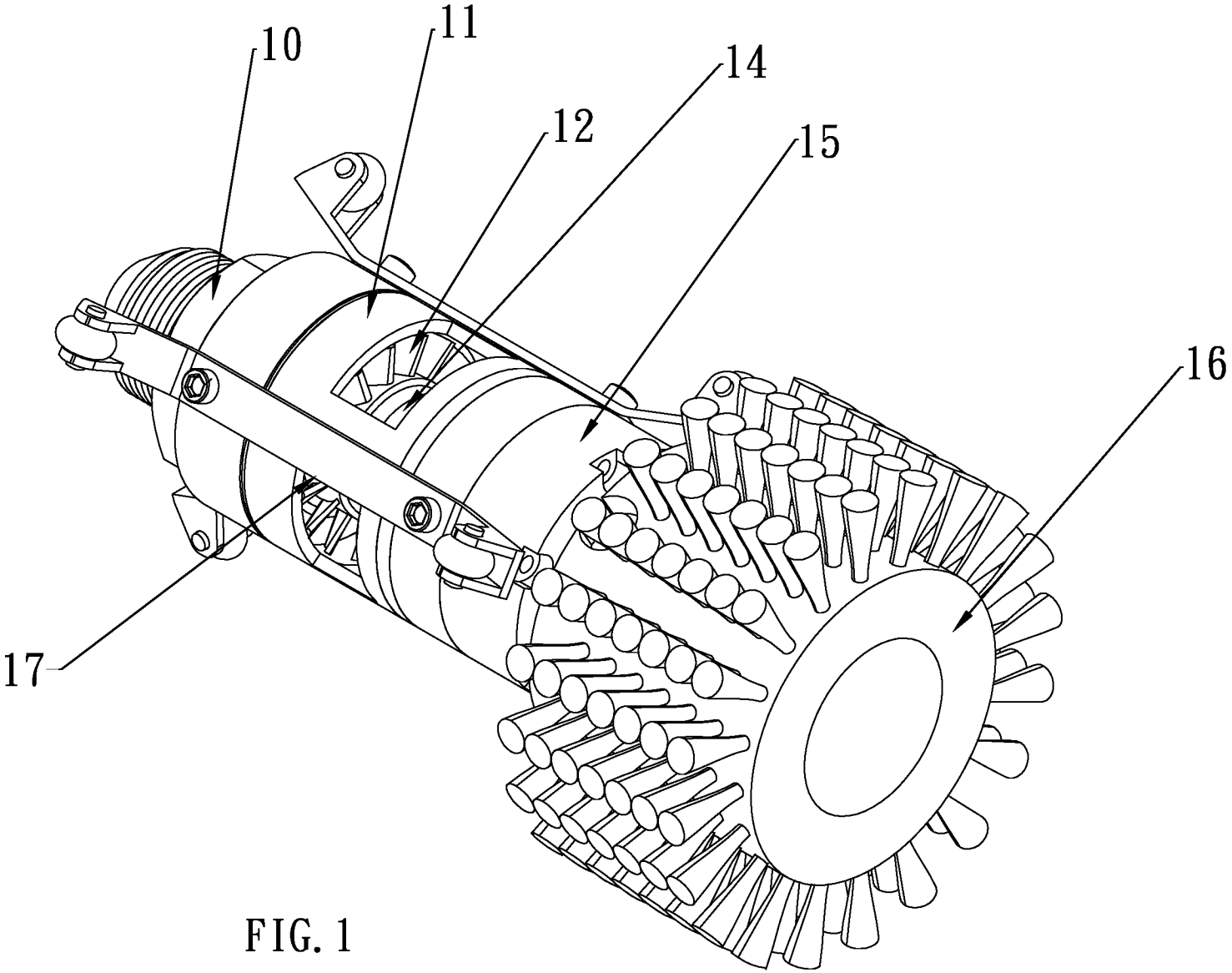
FIG. 1 is a perspective view showing the assembly of a device for washing pipes according to a preferred embodiment of the present invention.
Figure 2:
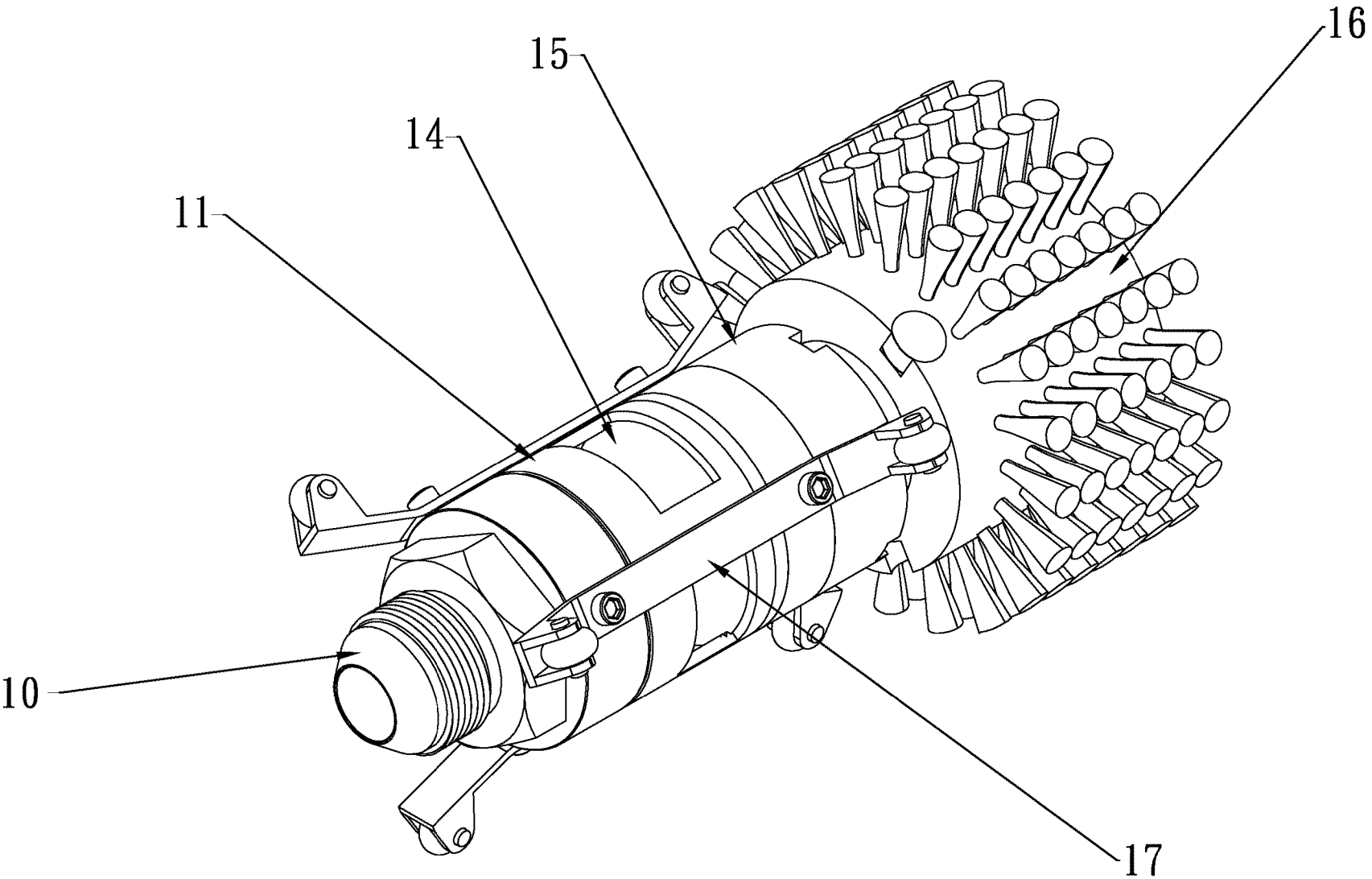
FIG. 2 is another perspective view showing the assembly of the device for washing the pipes according to the preferred embodiment of the present invention.
Figure 3:
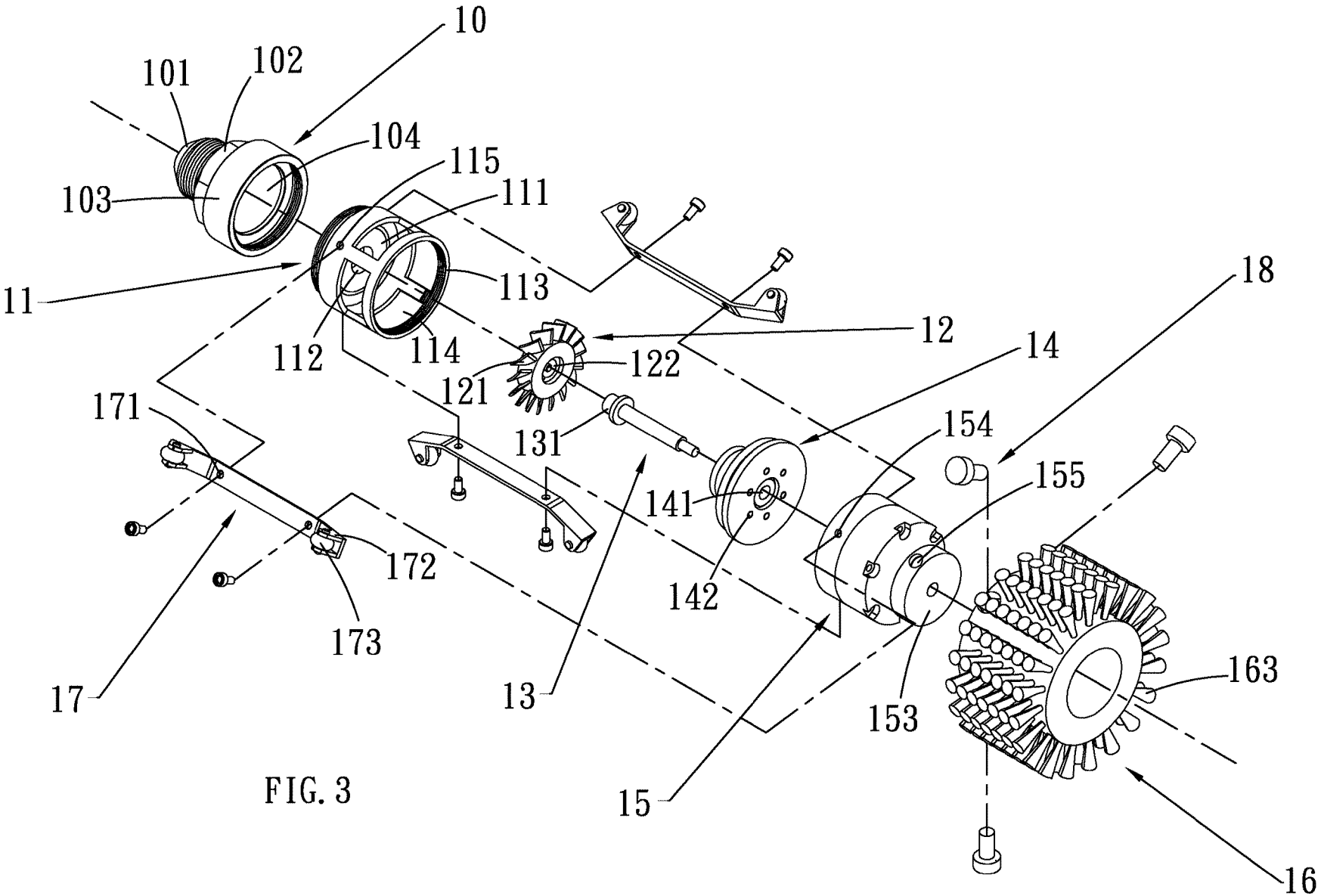
FIG. 3 is a perspective view showing the assembly of the device for washing the pipes according to the preferred embodiment of the present invention.
Figure 4:
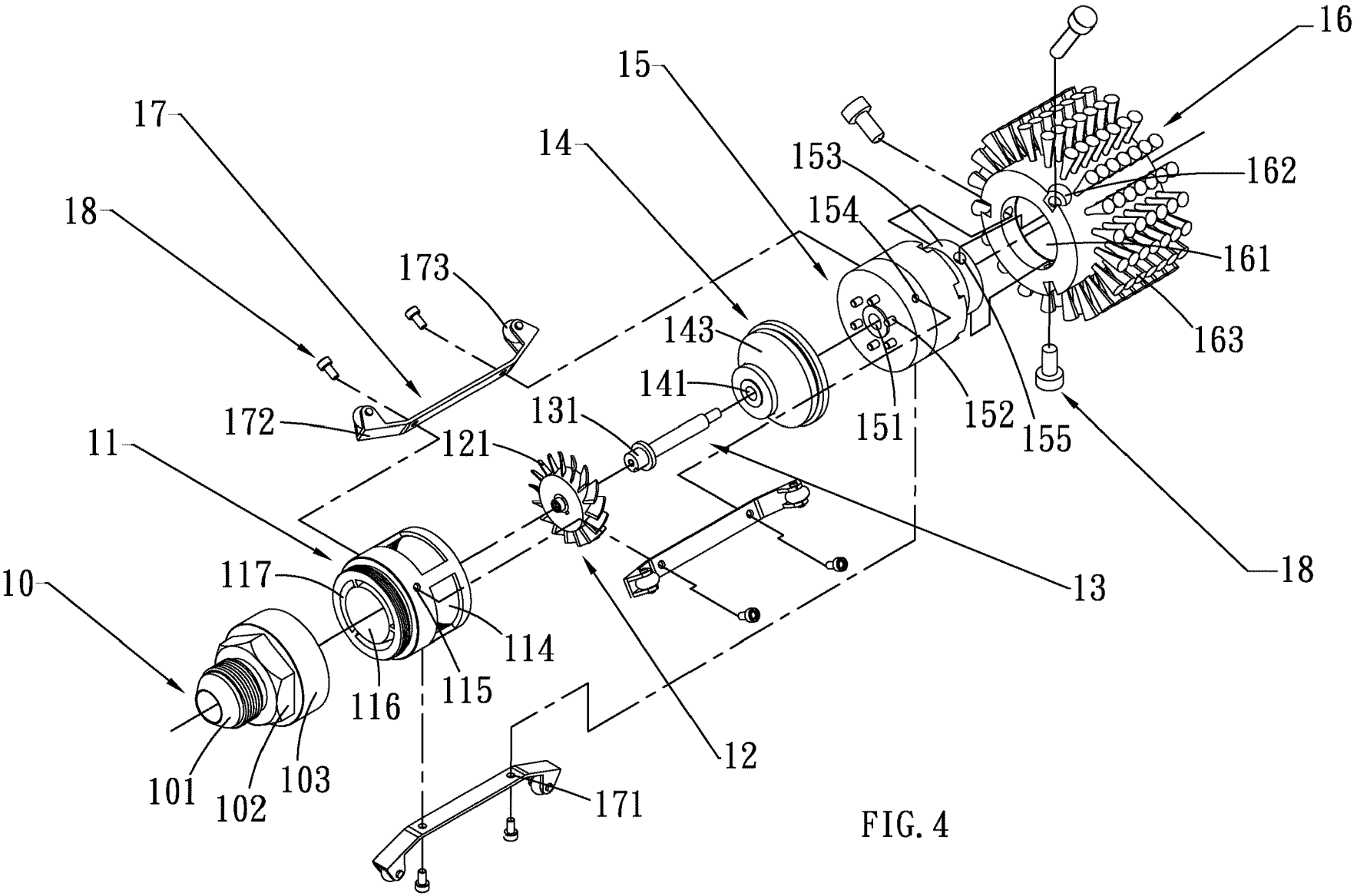
FIG. 4 is another perspective view showing the assembly of the device for washing the pipes according to the preferred embodiment of the present invention.
Figure 5:
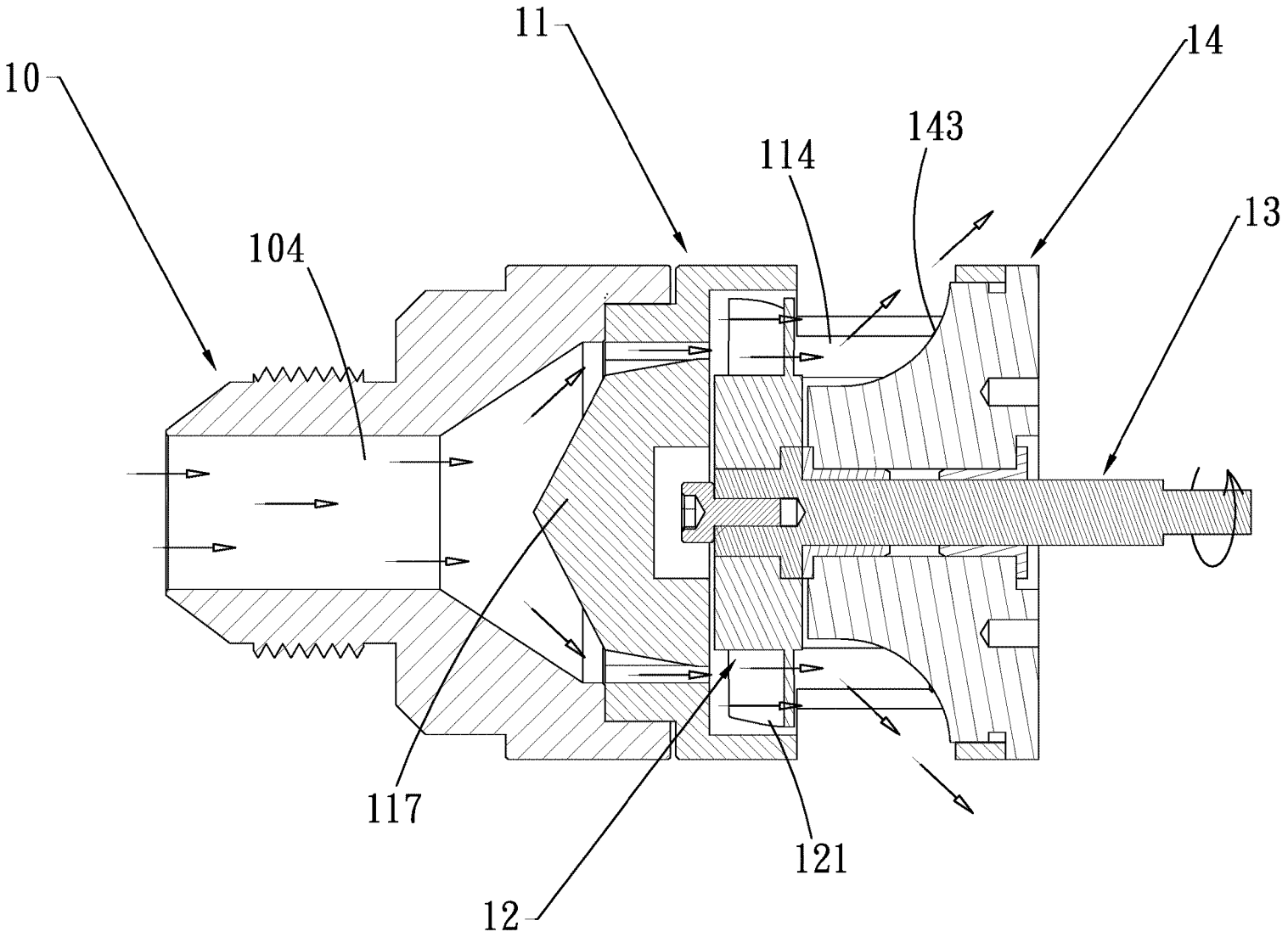
FIG. 5 is a cross sectional view showing the operation of the device for washing the pipes according to the preferred embodiment of the present invention.

With reference to FIGS. 1-5, a device 1 for washing pipes according to a preferred embodiment of the present invention comprises: a connector 10 being a stepped sleeve and including a conical inflow section 101, a threaded portion 102, a connection section 103 having inner threads, and an inlet 104 formed in a trumpet shape and defined in the connector 10; a case 11 being a hollow cylinder and including a partition 111 arranged on a front end of the case 11, an accommodation portion 112 defied on the partition 111, a screwing orifice 113 formed on a rear end of the case 11, multiple outlets 114 arranged on a peripheral side of the case 11, multiple fixing orifices 115 defined around the peripheral side of the case 11 adjacent to the conical inflow section 101, a conical guide portion 116 defined in a center of the front end of the case 11 and having outer threads, and multiple guiding orifices 117 defined between the guide portion 116 and the front end of the case 11 and passing through the partition 111; an impeller 12 including multiple fins 121 extending outward from an outer wall of the impeller 12, and the impeller 12 including a central hole 122 defined on a center of the impeller 12; a rotary shaft 13 including an affix segment 131 extending outwardly from a front end of the rotary shaft 13; an actuation portion 14 formed in a circular disc and including a first aperture A141, multiple second apertures 142 surrounding the first aperture A141, and a conduct portion 143 arranged on a front end of the actuation portion 14, wherein the conduct portion 143 has a first end adjacent to the impeller 12 and has a second end away from the impeller 12, a diameter of a first end of the conduct portion 143 is less than the second end of the conduct portion 143, and the second end of the conduct portion 143 has screw threads formed thereon; a transmission portion 15 being cylindrical and including a third aperture B151 defined on a front end of the transmission portion 15, multiple drive shafts 152 mounted around the third aperture B151, an output section 153 connected on a rear end of the transmission portion 15 and a diameter of the output section 153 being less than the transmission portion 15, the output section 153 having a planetary gear mechanism formed in the output section 153, multiple fourth apertures 154 defined on an outer wall of the transmission portion 15 proximate to the front end of the transmission portion 15, and multiple fifth apertures 155 arranged on an outer wall of the output section 153; a cleaning portion 16 including a first opening 161 defined on a center of the cleaning portion 16, multiple second openings 162 arranged on a front edge of an outer wall of the cleaning portion 16, and multiple clean elements 163 away from the front edge of an outer wall of the cleaning portion 16; multiple moveable portions 17, each of which has multiple coupling holes 171; and multiple positioning elements 18 configured to fix related components of the device 1.

In this embodiment, the case 11 includes three outlets 114, three fixing orifices 115, and three guiding orifices 117. The actuation portion 14 includes six second apertures 142, the transmission portion 15 includes six drive shafts 152 and three fourth apertures 154, and the cleaning portion 16 includes three second openings 162. A number of the multiple moveable portions 17 is three, and each moveable portion 17 is comprised of a holder 172 and two rollers 173. Each of the multiple positioning elements 18 is any one of a screw, a screw bolt, and a screw nail.

The conical inflow section 101 of the connector 10 is in connection with a water pipe (not shown), and the water pipe is coupled with the device 1 by using the threaded portion 102 of the connector 10. When the device 1 is accommodated and moves in the water pipe by pulling the water pipe and by using the two rollers 173 of each moveable portion 17, water is supplied via the water pipe and flows into the inlet 104 via the conical inflow section 101 of the connector 10, and the water flows into the three guiding orifices 117 of the case 11 so as to actuate the impeller 12 to rotate. Thereafter, the impeller 12 drives the rotary shaft 13 to revolve, the rotary shaft 13 actuates the actuation portion 14 and the transmission portion 15 to rotate, and the output section 153 of the transmission portion 15 drives the cleaning portion 16 to revolve so that the multiple clean elements 163 of the cleaning portion 16 washes the water pipe.

When the water flows through the inlet 104 of the connector 10 and the guide portion 116 of the case 11, the water flushes the multiple fins 121 of the impeller 12 so as to drive the rotary shaft 13 to rotate at a high speed and flows out of the three outlets 114 of the case 11 via the conduct portion 143 of the actuation portion 14, thus reducing resistance of the water to the impeller 12 and washing the cleaning portion 16 by way of the water.

The rotary shaft 13 further drives the actuation portion 14 and the transmission portion 15 and transmits a low torque to the six drive shafts 152 of the transmission portion 15 via the six second apertures 142 of the actuation portion 14, and the low torque converts into a high torque via the planetary gear mechanism of the output section 153, then the high torque transmits to the output section 153 of the transmission portion 15 so as to actuate the cleaning portion 16, hence the cleaning portion 16 accepts more resistance and enhances washing effect.

Preferably, the device 1 of the present invention is capable of washing an intake pipe.

Figure 6:
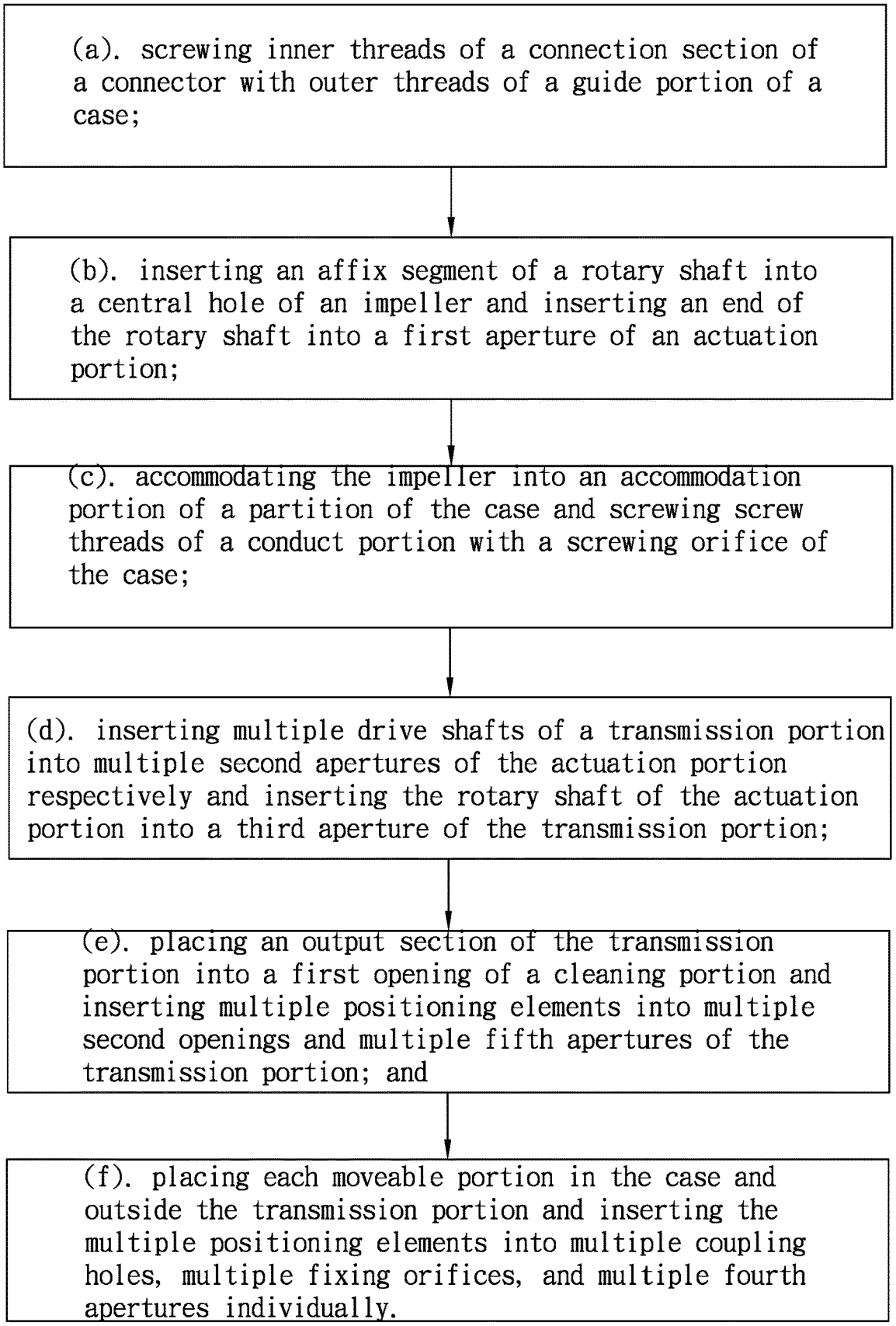
FIG. 6 is a flow view of a method of connecting the device according to the preferred embodiment of the present invention.

Referring to FIG. 6, a method of connecting the device comprises steps of:

(a). screwing the inner threads of the connection section 103 of the connector 10 with the outer threads of the guide portion 116 of the case 11;

(b). inserting the affix segment 131 of the rotary shaft 13 into the central hole 122 of the impeller 12 and inserting an end of the rotary shaft 13 into the first aperture A141 of the actuation portion 14;

(c). accommodating the impeller 12 into the accommodation portion 112 of the partition 111 of the case 11 and screwing the screw threads of the conduct portion 143 with the screwing orifice 113 of the case 11;

(d). inserting the multiple drive shafts 152 of the transmission portion 15 into the multiple second apertures 142 of the actuation portion 14 respectively and inserting the rotary shaft 13 of the actuation portion 14 into the third aperture B151 of the transmission portion 15;

(e). placing the output section 153 of the transmission portion 15 into the first opening 161 of the cleaning portion 16 and inserting the multiple positioning elements 18 into the multiple second openings 162 and the multiple fifth apertures 155 of the transmission portion 15; and (f). placing each moveable portion 17 in the case 11 and outside the transmission portion 15 and inserting the multiple positioning elements 18 into the multiple coupling holes 171, the multiple fixing orifices 115, and the multiple fourth apertures 154 individually.

While the preferred embodiments of the invention have been set forth for the purpose of disclosure, modifications of the disclosed embodiments of the invention as well as other embodiments thereof may occur to skilled in the art. Accordingly, the appended claims are intended to cover all embodiments which do not depart from the spirit and scope of the invention.

What is claimed is:

1. A device for washing pipes comprising:

a connector being a stepped sleeve and including a conical inflow section, a threaded portion, a connection section having inner threads, and an inlet defined in the connector;

a case being a hollow cylinder and including a partition arranged on a front end of the case, an accommodation portion defined on the partition, a screwing orifice formed on a rear end of the case, multiple outlets arranged on a peripheral side of the case, multiple fixing orifices defined around the peripheral side of the case adjacent to the conical inflow section, a conical guide portion defined in a center of the front end of the case and having outer threads, and multiple guiding orifices defined between the guide portion and the front end of the case and passing through the partition;

an impeller including multiple fins extending outward from an outer wall of the impeller, and the impeller including a central hole defined on a center of the impeller;

a rotary shaft including an affix segment extending outwardly from a front end of the rotary shaft;

an actuation portion formed in a circular disc and including a coupling aperture, multiple connection apertures surrounding the coupling aperture, and a conduct portion arranged on a front end of the actuation portion, wherein the conduct portion has a first end adjacent to the impeller and has a second end away from the impeller, a diameter of a first end of the conduct portion is less than the second end of the conduct portion, and the second end of the conduct portion has screw threads formed thereon;

a transmission portion being cylindrical and including a locating aperture defined on a front end of the transmission portion, multiple drive shafts mounted around the locating aperture, an output section connected on a rear end of the transmission portion and a diameter of the output section being less than the transmission portion, the output section having a planetary gear mechanism formed in the output section, multiple defining apertures defined on an outer wall of the transmission portion proximate to the front end of the transmission portion, and multiple limiting apertures arranged on an outer wall of the output section;

a cleaning portion including a first opening defined on a center of the cleaning portion, multiple second openings arranged on a front edge of an outer wall of the cleaning portion, and multiple clean elements away from the front edge of an outer wall of the cleaning portion;

multiple driving portions, a respective one driving portion of the multiple driving portions having multiple coupling holes; and multiple positioning elements configured to fix related components of the device.

2. The device as claimed in claim 1, wherein the case includes three outlets, three fixing orifices, and three guiding orifices.

3. The device as claimed in claim 1, wherein the actuation portion includes six connection apertures.

4. The device as claimed in claim 1, wherein the transmission portion includes six drive shafts.

5. The device as claimed in claim 1, wherein the transmission portion includes three defining apertures.

6. The device as claimed in claim 1, wherein the cleaning portion includes three second openings.

7. The device as claimed in claim 1, wherein the multiple driving portions are three driving portions, and the respective one driving portion is comprised of a holder and two rollers.

8. The device as claimed in claim 1, wherein each of the multiple positioning elements is any one of a screw, a screw bolt, and a screw nail.

9. A method of connecting the device of claim 1 comprising steps of:

(a) screwing inner threads of a connection section of a connector with outer threads of a guide portion of a case;

(b) inserting an affix segment of a rotary shaft into a central hole of an impeller and inserting an end of the rotary shaft into a coupling aperture of an actuation portion;

(c) accommodating the impeller into an accommodation portion of a partition of the case and screwing screw threads of a conduct portion with a screwing orifice of the case;

(d) inserting multiple drive shafts of a transmission portion into multiple connection apertures of the actuation portion respectively and inserting the rotary shaft of the actuation portion into a locating aperture of the transmission portion;

(e) placing an output section of the transmission portion into a first opening of a cleaning portion and inserting multiple positioning elements into multiple second openings and multiple limiting apertures of the transmission portion; and (f) placing a respective one driving portion of multiple driving portions in the case and outside the transmission portion and inserting the multiple positioning elements into multiple coupling holes, multiple fixing orifices, and multiple defining apertures individually.

* * * * *